US005820776A

United States Patent [19]

Hansen et al.

[11] Patent Number: 5,820,776

[45] Date of Patent: Oct. 13, 1998

[54] COMBINATION OF A NOVEL FIRE EXTINGUISHING COMPOSITION EMPLOYING A EUTECTIC SALT MIXTURE AND WATER AND A METHOD OF USING SAME TO EXTINGUISH FIRES

[75] Inventors: Steven W. Hansen; William Shipley; Debbie L. Wagner, all of Marinette, Wis.

[73] Assignee: Ansul, Incorporated, Marinette, Wis.

[21] Appl. No.: 857,274

[22] Filed: May 16, 1997

[51] Int. Cl.[6] ..... A62D 1/00

[52] U.S. Cl. ..... 252/2; 252/3

[58] Field of Search ..... 252/2, 3

[56] References Cited

U.S. PATENT DOCUMENTS

| | | | |
|---|---|---|---|
| 80,720 | 8/1868 | Galbraith | 252/2 X |
| 616,368 | 12/1898 | Stocker et al. | 252/2 X |
| 3,484,372 | 12/1969 | Birchall | 252/7 |
| 4,756,839 | 7/1988 | Curzon et al. | 252/2 |
| 4,950,410 | 8/1990 | Pennartz et al. | 252/7 |
| 4,961,865 | 10/1990 | Pennartz | 252/7 |
| 5,510,041 | 4/1996 | Sonnino | 252/3 |

*Primary Examiner*—C. H. Kelly
*Attorney, Agent, or Firm*—Morgan & Finnegan LLP

[57] ABSTRACT

The present invention relates to a novel fire extinguishing composition comprising a unique salt mixture and a method of using the novel composition combination with water to extinguish Class B and Class C fires. The fire extinguishing composition comprises an unique mixture of at least two salts, I and II: wherein I is selected from the group consisting of a bicarbonate or carbonate salt of sodium or potassium and II is selected from the group consisting of a chloride, sulfate, or tartrate salt of sodium or potassium and wherein the mixture exhibits a single minimum melting point. It has been found that the composition when applied as a combination with water provides excellent results in extinguishing class B fires, especially those involving cooking appliances using a large quantity of oil or fat, such as deep fryers.

20 Claims, 11 Drawing Sheets

COMBINATION OF A NOVEL FIRE EXTINGUISHING COMPOSITION EMPLOYING A EUTECTIC SALT MIXTURE AND WATER AND A METHOD OF USING SAME TO EXTINGUISH FIRES

BACKGROUND OF INVENTION

The present invention relates to a novel fire extinguishing composition comprising a unique salt mixture and a method of using the novel composition combination with water to extinguish Class B and Class C fires, which are difficult to extinguish. In particular, the fire extinguishing composition comprises an unique mixture of at least two salts, I and II: wherein I is selected from the group consisting of a bicarbonate or carbonate salt of sodium or potassium and II is selected from the group consisting of a chloride, sulfate, or tartrate salt of sodium or potassium and wherein the mixture exhibits a single minimum melting point. More particularly, it has been found that the composition when applied as a combination with water provides excellent results in extinguishing class B fires, especially those involving cooking appliances using a large quantity of oil or fat, such as deep fryers.

In the fire extinguishing art, fires are divided into four general classes; namely, Class A, Class B, Class C and Class D.

Class A fires are those involving ordinary combustible material such as paper, wood, etc. and can be extinguished by quenching and cooling with large quantities of water or solutions containing a large percentage of water.

Class B fires are those involving shortening, oils, greases, flammable liquids, etc. In this type of fire, the use of water is generally ineffective, because the contact of water with the hot oil causes a great amount of splattering without extinguishing the flames and the hot burning oil or grease may spread the fire. This type of fire is the most difficult to extinguish because of the low auto-ignition points of shortening, oils and greases which are in the range of about 360° C. to 380° C. Further, the presence of flammable materials in large quantities makes it extremely important to extinguish the fire as rapidly as possible and also bring the temperature down to prevent any reflash which occurs at a lower temperature of about 337° C.

Class C fires involve electrical equipment. Thus, the electrical conducting property of the extinguishing material is an important consideration. For this reason, it has been found that dry fire extinguishing agents are generally more useful. It has also been found that the fire extinguishing agents useful for Class B fires are generally also useful for Class C fires.

Class D fires involve combustible metals and are extinguished with special dry powders.

Many different fire extinguishing compositions and fire extinguishing systems using such compositions have been developed and are available on the market. However, re-flash or auto-ignition of the hot shortening, oils or greases in Class B fires remains a serious problem. This is true, particularly, when such fires involve large commercial establishments, such as restaurants, cafeterias, mess halls, etc. The potential danger of such fires in these types of establishments is widely recognized.

Carbonate or bicarbonate salts of sodium or potassium as fire extinguishing agents have been known. This is because carbon dioxide is generated when such salts are heated at a high temperature as dry solids. The carbon dioxide gas generated provides a blanket to smother the fire by depriving it of oxygen in the air.

Haissler et al., U.S. Pat. No. 3,463,233, disclosed the use of an alkaline solution, including those of potassium carbonate, to cause saponification of the burning oil or grease to provide a longer lasting blanket of carbon dioxide foam. The alkaline solutions which were described to be useful are concentrated solutions of any one of the salts: potassium carbonate, potassium hydrogen phosphate, tetrapotassium pyrophosphate, potassium acetate, potassium hydroxide, sodium, silicate and sodium hydroxide. Interestingly enough, solutions of sodium carbonate, trisodium phosphate and sodium tertraborate were found not to be useful for extinguishing fires. However, there are several problems with the use of these salts. The solution is highly alkaline and toxic. There is risk of corrosion of the kitchen appliances and environmental pollution from the discharge of the material into the sewage system. Further, the carbon dioxide generated dissipates quickly and re-ignition of such fires remain a serious problem.

Dunn, U.S. Pat. Nos. 3,889,754 and 3,889,757 described a dry chemical agent comprising a mixture of 95% by weight of carbonate or bicarbonate salts of sodium or potassium with 5% by weight of a synthetic metal silicate for use with specially designed distribution nozzles for use in the kitchen. The presence of the sodium silicate prevents clogging of the nozzles by the dry fire extinguishing agent. However, the problems with re-ignition, corrosion and pollution remain.

Other fire extinguishing agents for Class B fires have also been proposed. Curzon et al., U.S. Pat. No. 4,756,839, disclosed the adding of a boron containing compound to potassium carbonate for stove top fires to prevent corrosion of metal surfaces. Szekely et al. disclosed the application of a powder containing 10% to 90% of a sesquicarbonate of sodium, potassium or ammonium with potassium or sodium carbonate/bicarbonate for extinguishing burning gasoline. It also described other active ingredients for fire extinguishing. These include salts such as sodium or potassium phosphates, hydrophosphates, and hydrophosphates; sulfates and hydrosulfates and borates; boric acid; abducts of the above salts with urea, guanidine dicyandiamide and melamine and polymers and polyssacharides. The ingredients and additives described therein are toxic and/or corrosive. The problem of re-ignition without the use of large quantities of these agents remains unsolved.

Existing fire extinguishing systems and agents have also proven to be of decreasing effectiveness since the energy crisis of the early 1970s. This is because the design of cooking appliances, particularly deep fryers, have been modified to provide improved insulation for energy conservation. The improved insulation has made fires involving cooking appliances, such as deep fryers, much more difficult to extinguish and secure. Furthermore, the shortening or oils used by the fast food establishments are maintained at a hotter temperature and together with the improved insulation pose a greater risk of fire and re-ignition. It has been found that an increased amount of fire extinguishing agent is required to put out the flames, to secure and prevent re-flash of the hot oil. The large amount of fire extinguishing agent that is necessary leads to other problems, such as providing adequate space for the storage of the fire extinguishing agent, increased risk of corrosion of the kitchen appliances and further difficulties in clean-up and removal of materials which may be toxic, and/or corrosive after the fire has been extinguished.

Because of these problems, new and better fire extinguishing agents and methods of extinguishing and securing fires, also referred to as suppression of fires, in commercial cooking establishments are needed.

Accordingly, an object of the present invention is to provide novel fire extinguishing agents which are much more effective to reduce the amount of the agent required to extinguish the fire.

Another object of the invention is provide fire extinguishing agents which will efficiently and rapidly extinguish the flames and prevent re-flash.

A third objective of the invention is to provide fire extinguishing agents which will form a foam on the oil and a method of maintaining the foam until the oil has cooled down to below the reflash temperatures.

A further objective is to provide fire extinguishing agents that are less toxic and can be stored or disposed of without causing environmental problems.

In this application the term "oil" is meant to include "shortening", "grease", "lard" or any oil medium used for cooking.

SUMMARY OF THE INVENTION

According to the present invention, a novel fire extinguishing composition comprising a unique mixture of at least two salts I and II, wherein I is selected from the group consisting of a carbonate or bicarbonate of sodium or potassium and II is selected from the group consisting of a chloride, sulfate, or tartrate salt of sodium or potassium, and the mixture I and II exhibits a single minimum melting temperature range by DSC. The mixture is particularly effective when applied as a combination with additional water. The characteristic of this unique mixture is analogous to that of a eutectic wherein a mixture of two or more metals or salts exhibit a minimum melting point. I is a salt having the following characteristics: it dissociates to form carbon dioxide when heated, and it is soluble at a range of about 25 g to 150 g/100 ml of water. II is a salt or a mixture which when mixed at a particular ratio with I will provide a single minimum melting temperature range. It was found that by adding a small amount from 10 mole % to 20 mole % of II to I, the mixture exhibits a single minimum melting temperature range, lower than that of I alone or II alone. Also, at this temperature, the heat capacity of the mixture, its ability to absorb heat, is at a maximum, a value that is in excess of the heat capacity of the individual components. The single minimum melting temperature range is determinable by the use of differential scanning calorimetry (DSC).

It is found that when the unique mixture is applied as a fire extinguishing agent followed by water, the combination is extremely effective for extinguishing Class B fires involving oils or greases and will prevent re-flash/auto-ignition. The mixture may be sprayed onto a fire as a concentrated aqueous solution of about 15%–30% by weight in water, followed by further application of water. The mixture when initially sprayed onto a fire at a flow rate of about 4.5 L/min to 7.5 L/min will generate a thick layer of foam containing carbon dioxide. At these flow rates the pressure is about 30 psi to 100 psi. This thick layer of foam smothers the burning flame rapidly, within 2–10 seconds. When followed by the application of water, further foaming is generated together with rapid cooling of the hot oil/grease. An application of water for 2 minutes at a similar flow rate of about 4.5 L/min to 7.5 L/min causes more foaming and at the same time reduced the temperature of the hot oil to below 330° C. so that reignition is prevented.

Apparently, the unique mixture when applied to the burning oil absorbs a large amount heat from the oil. It has been found that at a flow rate of about 4.5 L/min/nozzle–7.5 L/min/nozzle, a 2–10 sec application of a 25 wt % solution of a mixture of potassium bicarbonate with sodium sulfate in a mole % ratio of 85:15 followed by a 2–10 minute application at the same flow rate of water completely extinguishes an actively burning deep fryer containing about 50 L. (13 gal.) of cooking oil. Furthermore, the oil is cooled down to below 330° C. to prevent re-flash.

The hybrid combination of an aqueous solution of the mixture and water may be applied manually to the fire. However, it is preferable to apply the fire extinguishing agent followed with water via an automated fire suppression system with a unique valve assembly to control the sequential discharged of the fire extinguishing agent followed by the water and a specially designed appliance nozzle. The system can be installed in a hood over the cooking appliances.

DETAILED DESCRIPTION OF THE INVENTION

Figure 1:
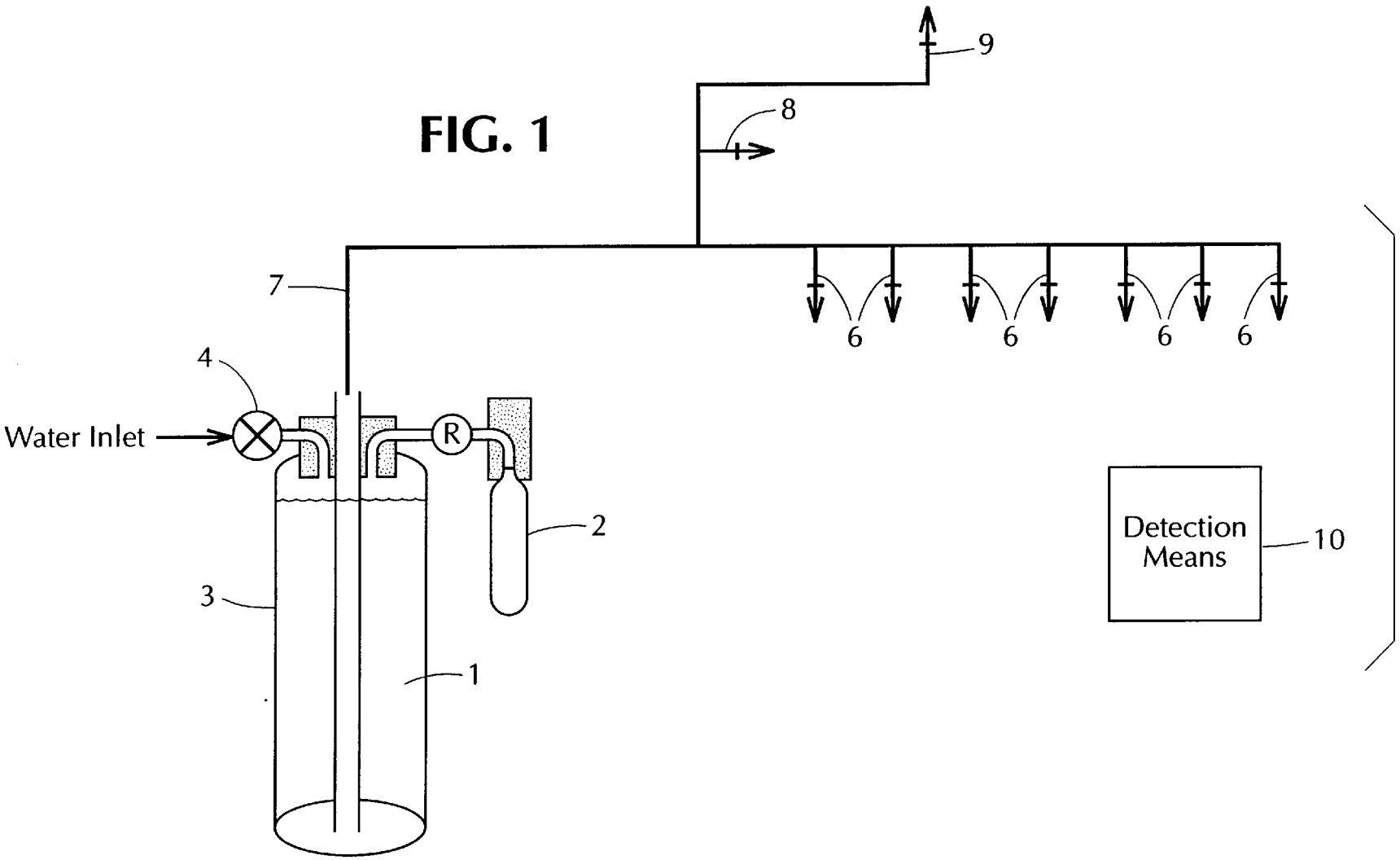
FIG. 1 is a schematic for a preferred fire suppression system using the fire extinguishing composition of the present invention. A tank 3 holding a solution of the fire extinguishing composition is connected through pipes 7 to appliances nozzles 6, plenum nozzles 8 and duct nozzles 9. A valve assembly 4 (For details, see FIGS. 3A and 3B) mounted on the tank controls the sequence release of the solution of the fire extinguishing composition followed by water and is activated by the high pressure gas released from gas cartridge 2.

The present invention provides a fire extinguishing composition for fires and a method for extinguishing same to prevent reflash.

The fire extinguishing composition comprises a mixture of salt I and salt II in a ratio of 80 mole % to 90 mole % of salt I to 20 mole %–10 mole % of salt II, wherein salt I is selected from the group consisting of a carbonate or a bicarbonate of sodium or potassium; salt II is selected from the group consisting of a chloride, a sulfate, or a tartrate of sodium or potassium and wherein the mixture of Salt I and Salt II exhibits a single minimum melting temperature range. The mixture also exhibits a maximum heat absorbance capacity for the phase transition. The mixture of salt I and salt II may be prepared as an aqueous solution at a concentration of 15 wt %–30 wt % or the solution may be prepared in situ by passing water through the mixture in the form of a dry powder.

The method of extinguishing fires of the present invention comprises spraying a solution of the mixture of salt I and salt II at a concentration of about 20 wt %–30 wt % following by water.

The composition of the present invention is unique in that the mixture has a single melting temperature range that is lower than salt I alone or salt II alone. The heat absorbed in the transition as shown by its DSC endotherm is at a maximum. See FIGS. 4A–4G for potassium bicarbonate and sodium sulfate. At a mole % ratio of about 88:12 to 80:20 of potassium bicarbonate to sodium sulfate a single endotherm for the phase transition is observed for each mixture. The temperature at which the transition initiated, as measured at the start of the endotherm, is at a minimum of about 184° C. and the energy absorbed, calculated based on DSC endotherm is about 5066 joules/g. This unique characteristic of the novel fire extinguishing agent enables the rapid extinguishing of the flames by providing a thick blanket of carbon dioxide foam formed from the decomposition of the carbonate/bicarbonate and the saponified hot oil together with the rapid absorption of heat from the burning oil/grease. A discharge of 2–10 sec at a nozzle flow rate of from about 4.5 L/min/nozzle to 7.5 L/min/nozzle of the agent at a concentration of 15 wt %–30 wt % in water is sufficient to extinguish an actively burning fire in a deep fryer. When the agent discharge is followed by water, further foaming occurs and the temperature of the hot oil is rapidly cooled to 315° C., below the re-ignition temperature of cooking oils and greases. The amount of water added is at the same flow rate, in the range of about 4.5 L/min–7.5 L/min for about 2–10 min.

It has been found that the sequential combination of the fire extinguishing agent and water is very efficient to extinguish an active Class B fire. A 10 second spray of an aqueous 25 wt % solution of a mixture of potassium of an aqueous 25 wt % solution of a mixture of potassium bicarbonate with sodium sulfate in a mole % ratio of 85:15 when combined with a 2–10 min spray of water at a flow rate of 4.5 L/min at 30 psi is sufficient to extinguish an actively burning deep fryer and prevent re-ignition. In contrast, when an available fire extinguishing composition, such as those containing potassium citrate, potassium acetate or potassium carbonate is used, the fire was extinguished in about 3–8 sec at a flow rate of 4.5 L/min; but reflash occurred in about 10–15 sec Moreover, the temperature of the oil remained at above 330° C. for over 15 min. In contrast, even without the addition of water, an active fire will be extinguished with a 2 sec application of the composition of the present invention at a flow rate of 4.5 L/min at 30 psi. The thick layer of foam formed will hold and prevent reflash for about 18–23 sec. With the sequential addition of water for about 1 min at the flow rate of 4.5 mL/min, the temperature of the oil is reduced to below 330° C., the reflash point of oils and greases. The dramatic and unexpected increase in efficiency in extinguishing and securing the fire enable the development of an improved and much simplified fire extinguishing system.

The hybrid combination of fire extinguishing agent and water of the present invention may be applied manually. However, the intense heat and smoke generated in such fires may pose potential dangers. Therefore, it is preferable to provide a system with a fire detection system which automatically actuates the sequential discharge of the fire extinguishing composition followed by water.

To ensure the best performance from the fire extinguishing composition of the present invention, a fire extinguishing system with a novel valve assembly for controlling the discharge of the fire extinguishing agent followed by water has been designed. The system includes a fire detection device, which actuates a gas motor to pierce the seal of a nitrogen cartridge, which in turn activates a novel valve assembly to discharge sequentially the fire extinguishing composition and water. The system also includes a special designed nozzle for covering all of the cooking appliances in a restaurant kitchen. The valve assembly may be installed on the top of the tank holding the fire extinguishing composition as an aqueous solution or remotely therefrom. The preferred fire suppression systems are described herein below.

The fire suppression system employing the unique valve assembly and appliance nozzle is the subject matter of a separate application, Ser. No. 08/857,546 entitled FIRE SUPPRESSION SYSTEM filed contemporaneously herewith. The co-pending application is expressly incorporated herein by reference.

Figure 2:
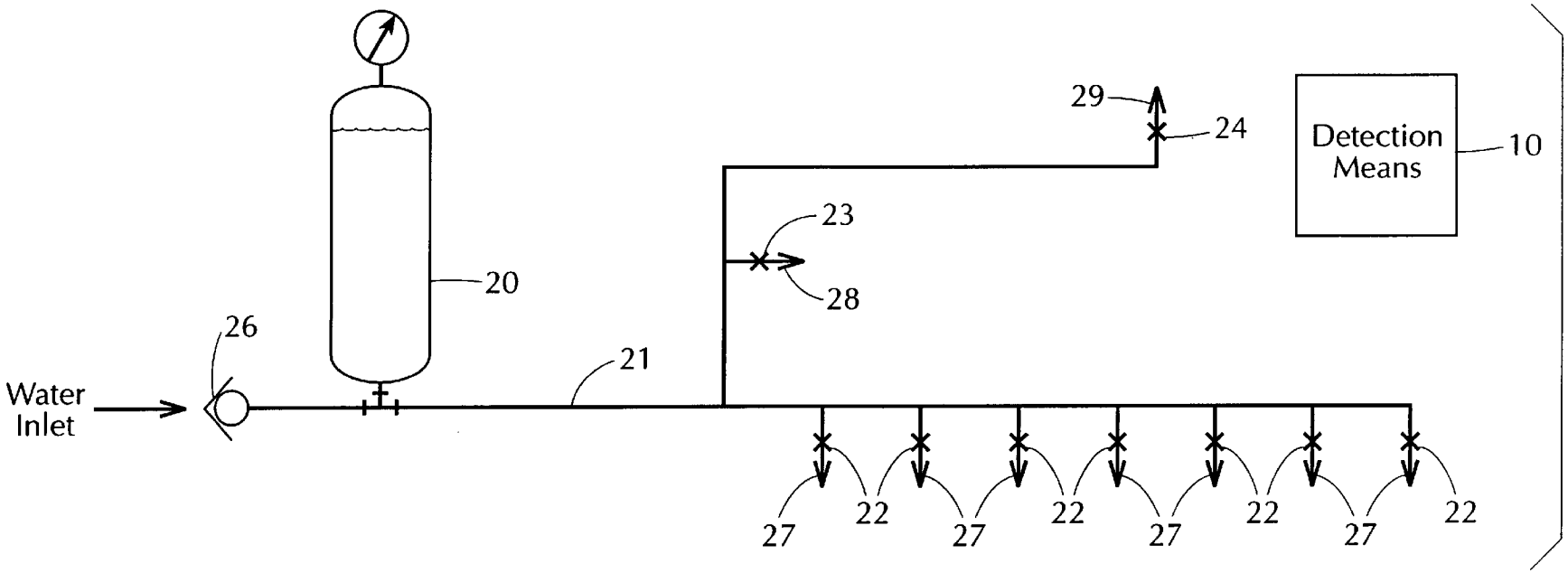
FIG. 2 is a schematic of a second embodiment of a fire extinguishing system, wherein the solution of the fire extinguishing agent is stored in the pipes and the tank under high gas pressure. The nozzles 5, 6 and 7 contain valves which are opened when a fire is detected. The high pressured gas in the tank forces the agent to be discharged through the opened valves of the nozzles and prevents the water from flowing in. When the gas pressure is reduced to about 45 psi, the water flows in and is discharged through the nozzles.

The fire suppression systems for use in a commercial kitchen are usually installed as a part of the exhaust hood over the cooking range. One embodiment of the fire suppression system is shown in FIG. 1. A tank 3 holding a solution of the fire extinguishing composition is connected through pipes 7 to appliance nozzles 6, plenum nozzles 8 and duct nozzles 9. A valve assembly 4 mounted on the tank 3 controls the sequential release of the solution of the fire extinguishing composition followed by water. When a fire is detected by a detection means 10, a seal in a gas cartridge 2 is punctured and gas at high pressure is released from gas cartridge 2. For the operation of the valve, see the description for FIGS. 3A and 3B herebelow. The embodiment shown in FIG. 2 is a wet pipe system. Before system actuation, the storage tank 20 and the distribution piping 21 are filled with wet agent. The tank 20 and distribution piping 21 are under pressure from compressed gas in the top of the agent tank. or more of the heat activated nozzle valves 22, 23, 24 opens in response to heat from hostile fire(s), wet agent is automatically expelled from the agent tank 20 and distribution piping 21 through the open nozzles 27, 28, 29 by the compressed gas in the tank 20. When the compressed gas pressure drops below in the water pressure at the water inlet check valve 26, water will automatically flow through the distribution piping 21 and the same open nozzles 27, 28, 29 until the water supply is manually shut off. Only those nozzles 27, 28, 29 which open in response to heat from hostile fire will automatically discharge agent and water onto the burning hazards.

Figure 3A:
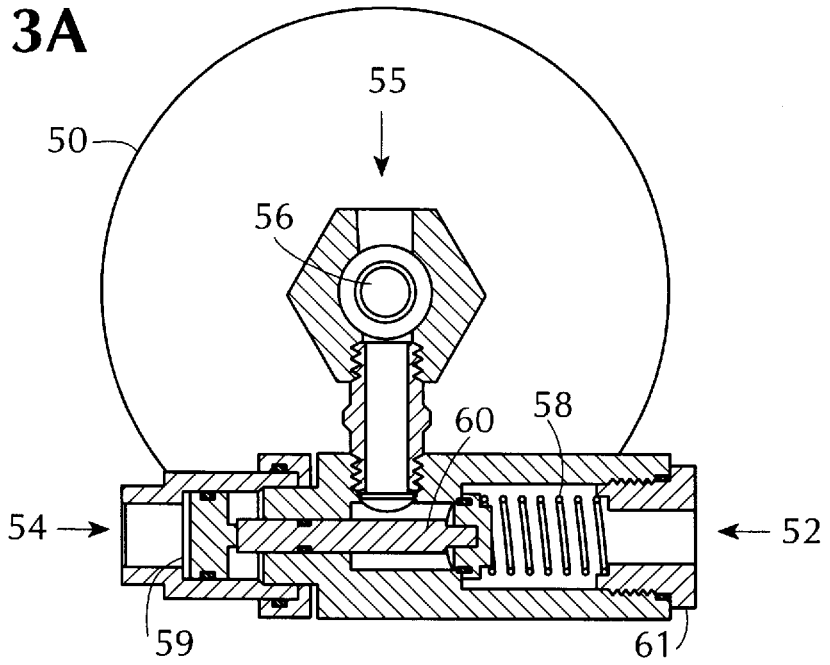
FIGS. 3A and 3B are details of an embodiment of a valve of a dry pipe fire suppression system using the fire extinguishing composition of the present invention.
Figure 3B:
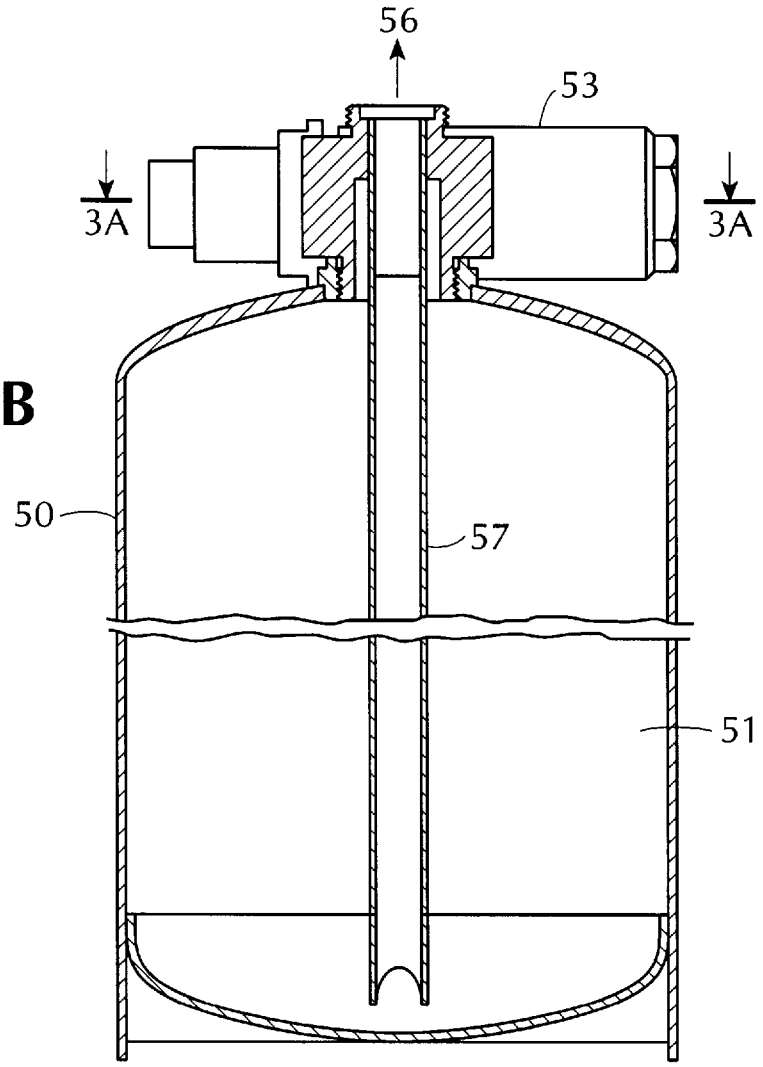
Figure 4A:
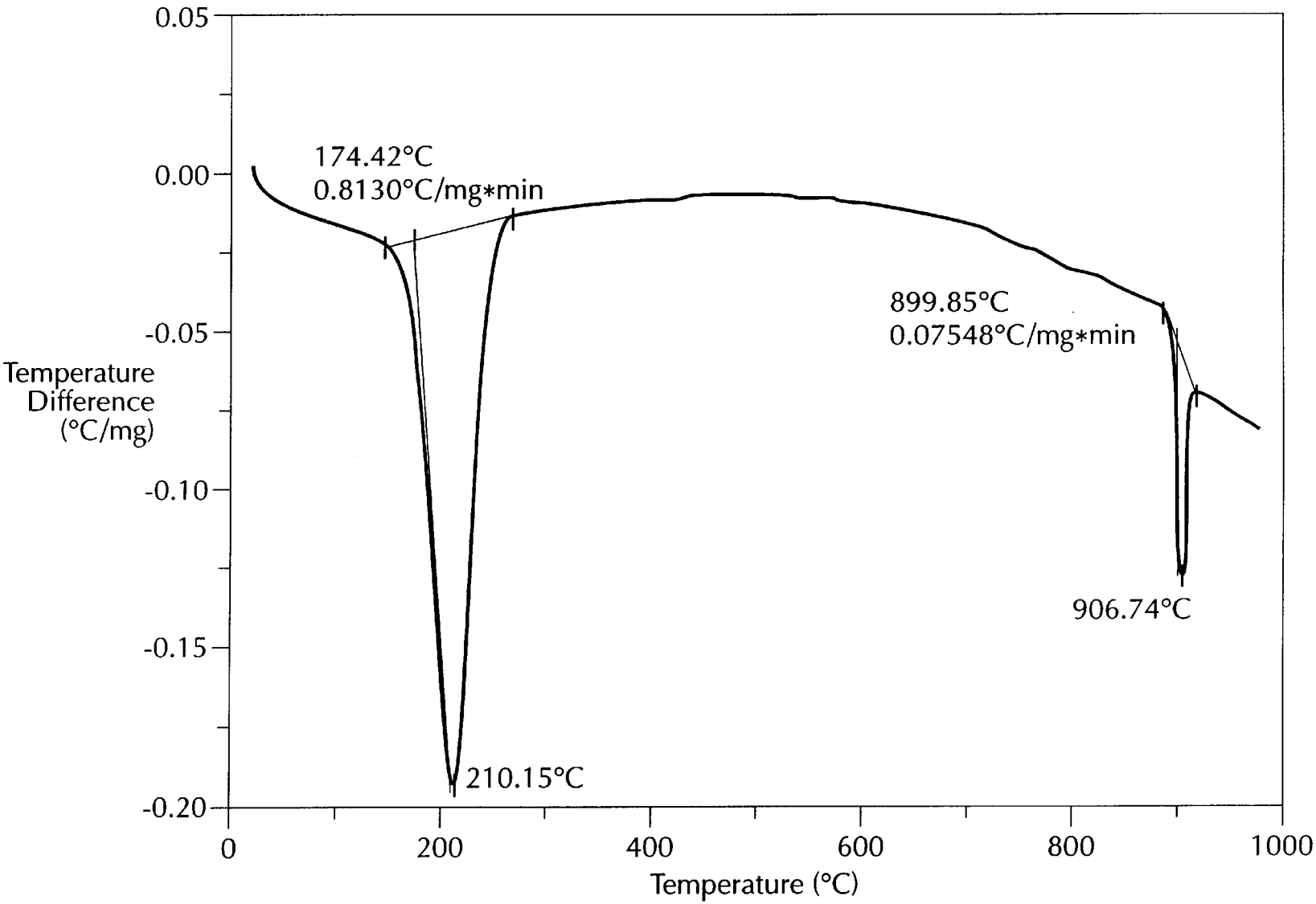
FIG. 4 A, B, C, D, E, F and G are DSC curves for mixtures of potassium bicarbonate and sodium sulfate. The temperature is increased at a rate of 10° C./min; wherein the mole % ration of potassium bicarbonate to sodium sulfate are 100:0; 96:4; 94:6; 90:10; 85:15; 80:20; and 0:100.
Figure 4B:
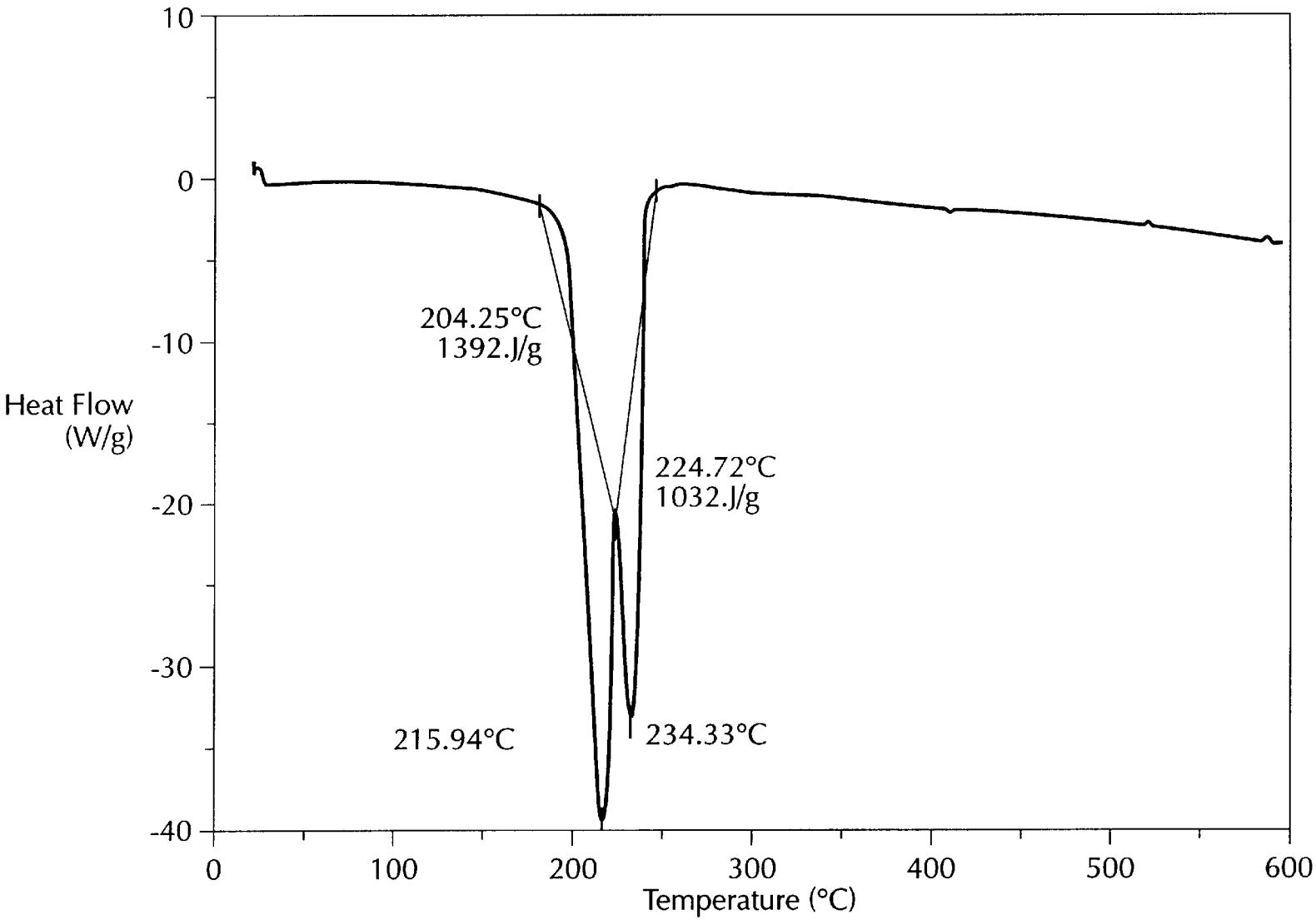
Figure 4C:
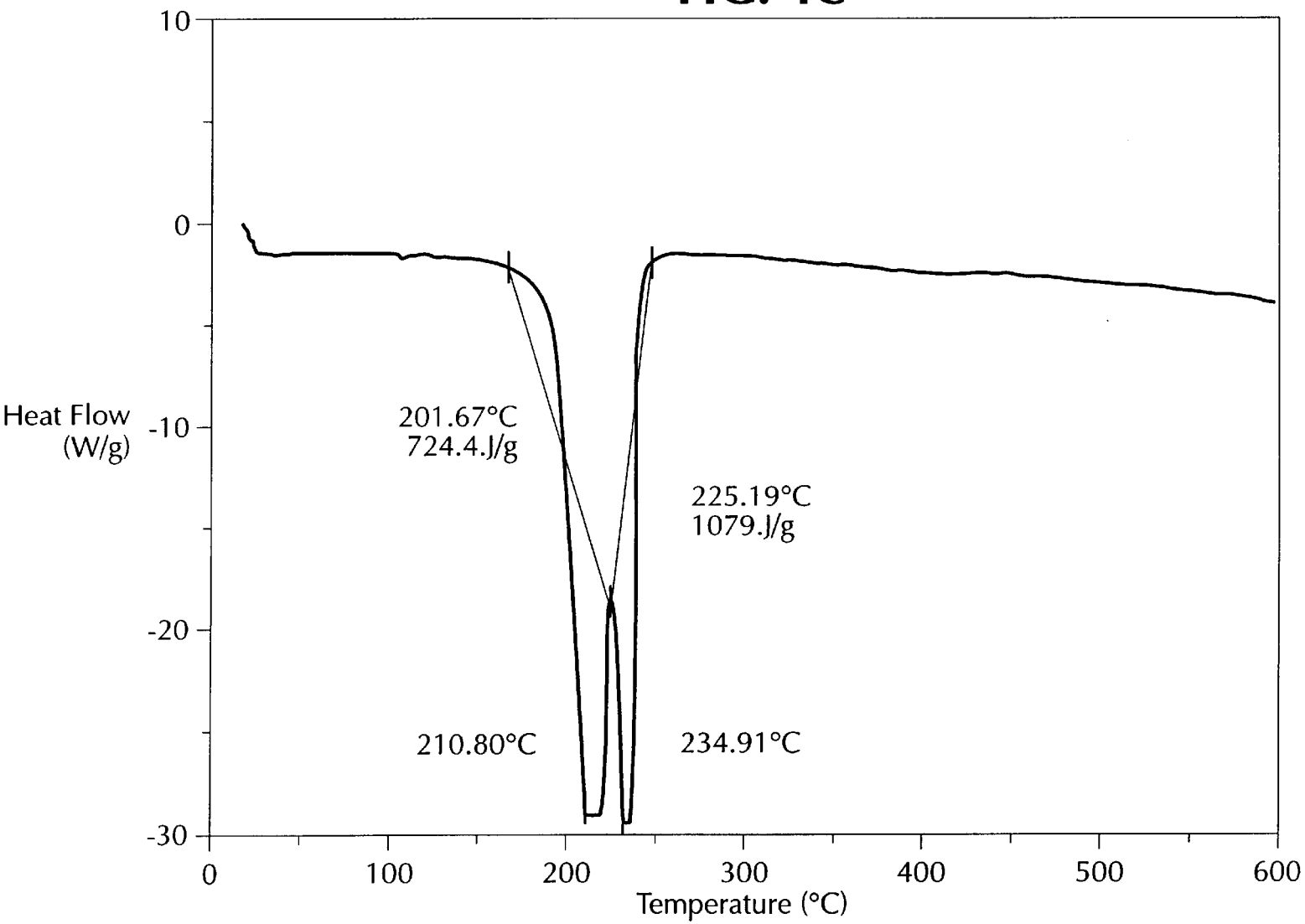
Figure 4D:
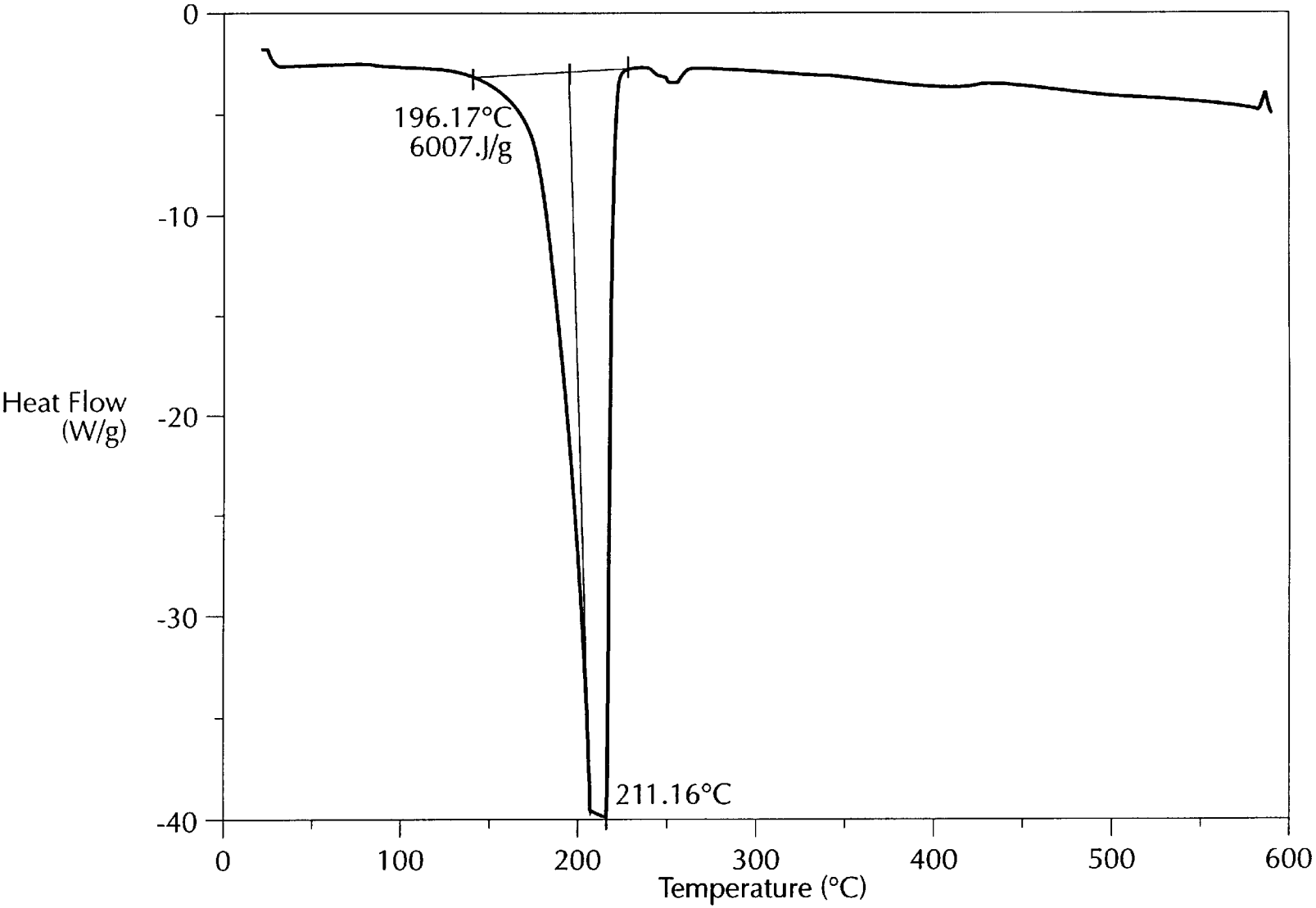
Figure 4E:
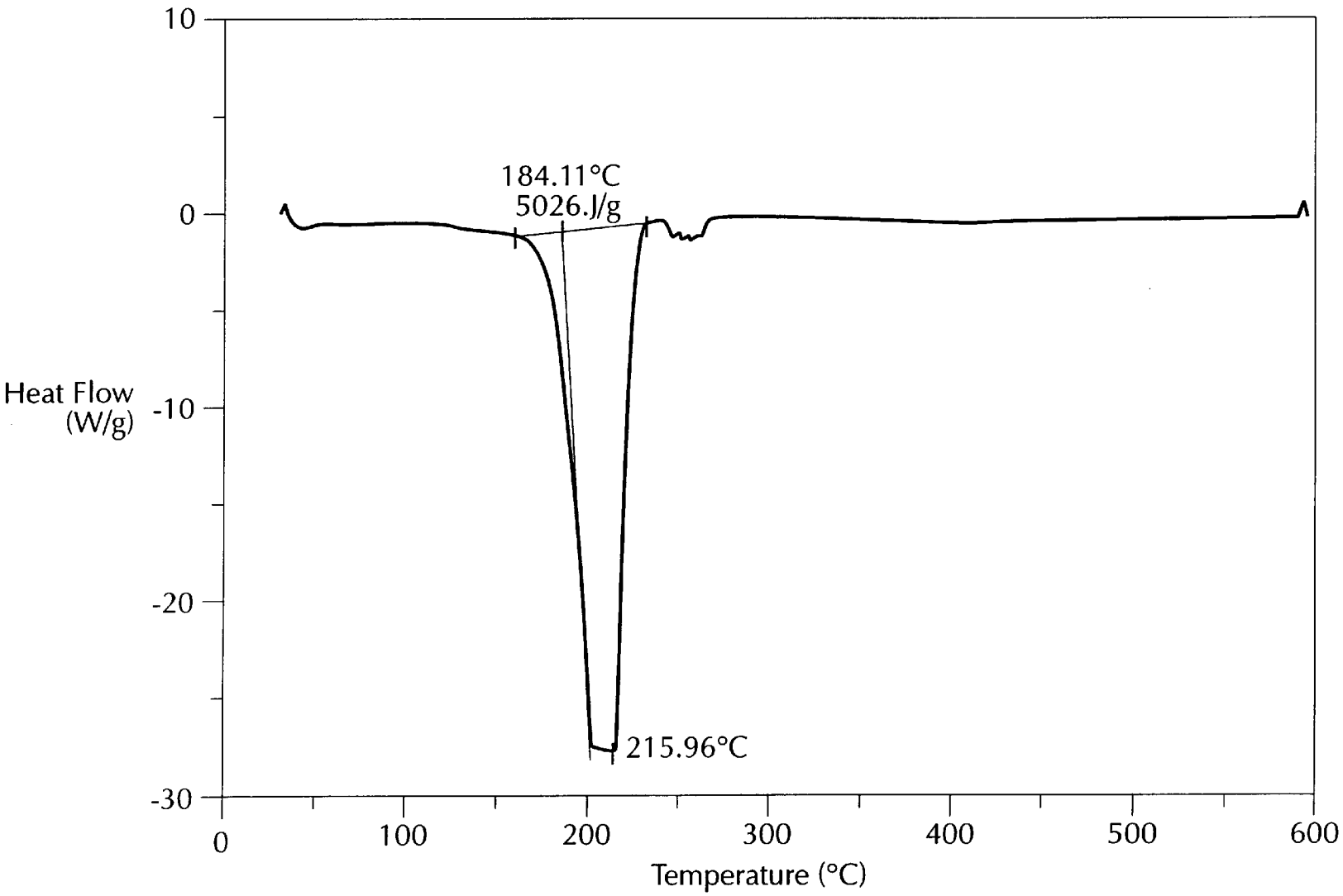
Figure 4F:
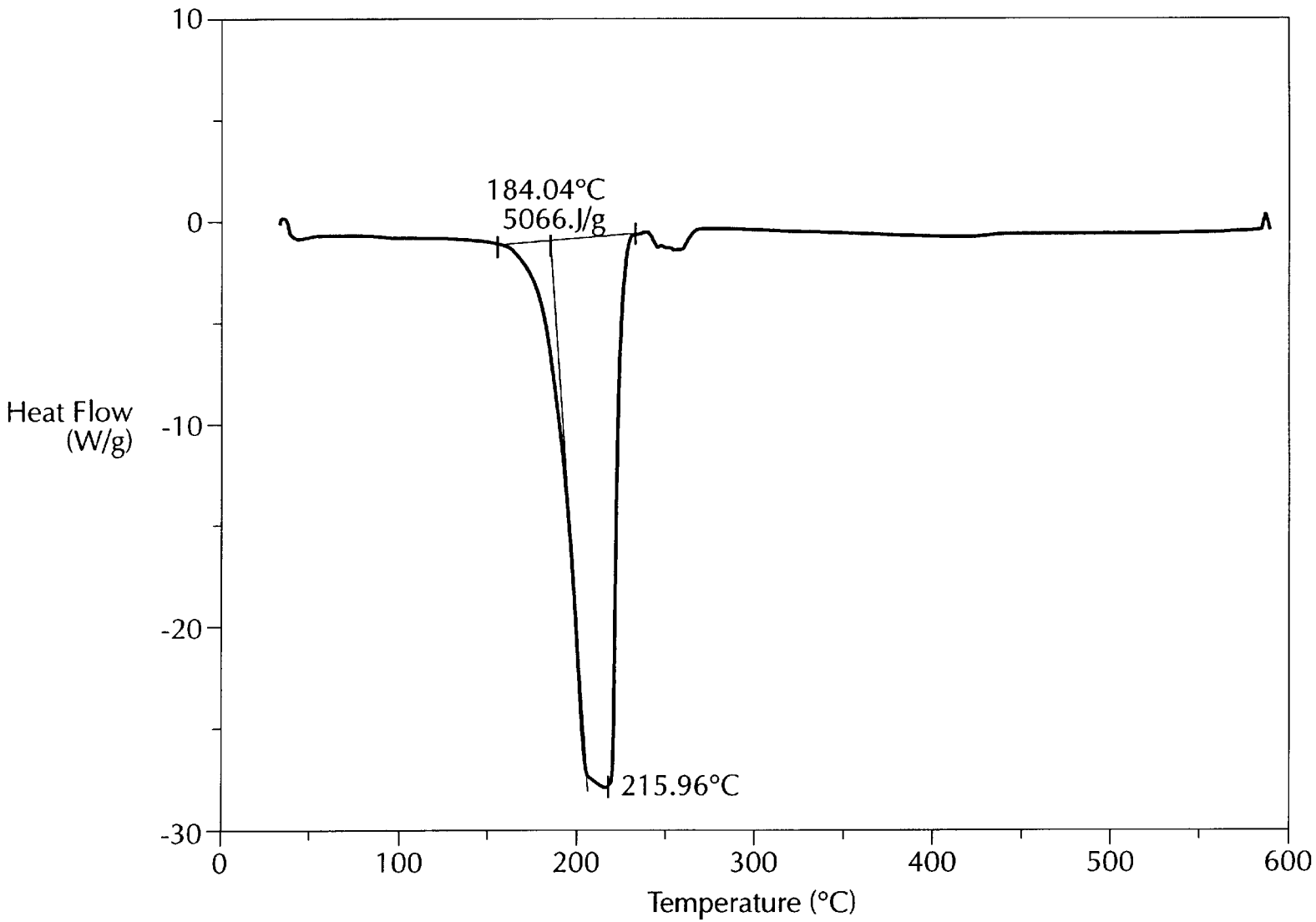
Figure 4G:
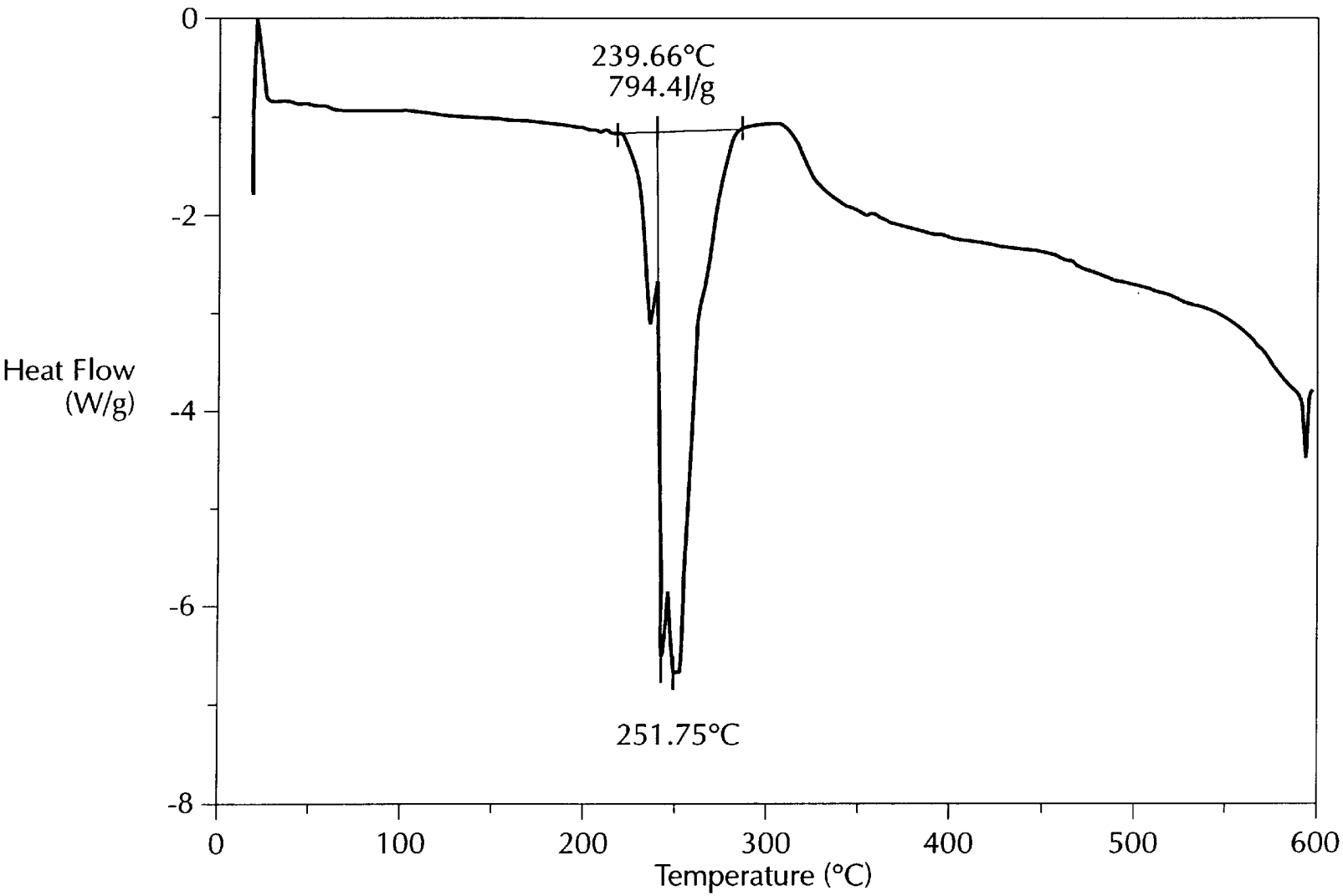

FIGS. 3A and 3B show an automatic valve of a dry pipe fire suppression system useful with the fire extinguishing composition of the present invention. Tank 50 is filled with the wet chemical agent 51 under atmospheric pressure. The water inlet port 52 of the valve assembly 53 is piped to a source of water supply. The valve 53 is closed and is under static water pressure. The connected water line (not shown) includes a check valve (not shown) to prevent backflow when the system is initially actuated. The high pressure gas inlet port 54 of the valve 53 is piped to the high pressure side of the gas pressure regulator (not shown) on the spring-loaded release assembly (not shown) and is under atmospheric pressure until the fire protection system is actuated. The high pressure line (not shown) includes a check valve (not shown) to trap high pressure gas in the line when the system is actuated. As an optional feature, the high pressure gas line may include a bleed orifice so that the high pressure gas is slowly released to allow water pressure to automatically close the valve after the water has discharged for a minimum duration, to minimize flooding. The low pressure gas inlet port 55 on the pick-up tube assembly is piped to the low pressure side of same gas pressure regulator and the low pressure side of same gas pressure regulator and is also under atmospheric pressure until the system is actuated. The gas pressure regulator (not shown) is piped to a gas cartridge, small pressure vessel (not shown), which contains a fixed volume of nitrogen or carbon dioxide expellant gas under high pressure. The tank discharge outlet 56 on the pick-up tube assembly 57 is piped to multiple discharge nozzles (not shown), each aimed at a potential fire hazard.

When a hostile fire is detected by the fire protection system, the spring-loaded release assembly (not shown) automatically actuates to puncture the seal of the expellant gas cartridge, thereby releasing gas under high pressure to both the high pressure gas inlet of the valve 54 and the pressure regulator, where the high gas pressure is reduced to a lower operating pressure. The high pressure gas opens the valve 53 to the water supply by thrusting the piston 59 and stem assembly 60 towards the water inlet 52 against the force of the spring 61 and the static water pressure. Once the stem assembly 59 is unseated, the trapped high pressure gas will hold it open until the gas pressure is manually released after the fire event when the system is recharged and reset. The low pressure gas from the regulator enters the top of tank to expel the wet agent 51 from the tank 50 through the tank discharge outlet 56, discharge piping (not shown) and discharge nozzles (not shown). Once the low pressure gas is flowing, the regulator will feed the low pressure gas into the tank at a constant pressure until the decaying pressure of the gas in the fixed-volume cartridge falls below the preset outlet pressure of the regulator, at which time the gas pressure from the regulator will also decay with time.

Although the valve was opened initially by the high gas pressure, water will not flow into the tank 50 until the water pressure from the water supply overcomes the decaying gas pressure of the low pressure gas in the top of the tank 50, at which time water will automatically commence flowing through the tank 50, discharge piping and the discharge nozzles. Water will continue to flow until it is manually shutoff upstream from the valve after the fire event is concluded.

This valve is operated by cartridge pressure which assures the proper switch of extinguishing agent to water without the use of electrical devices. This design is more economical because it does not require the expense of a control panel to supervise the circuits as required by NFPA.

Previously, with commercially available fire extinguishing agents it was found that a 3 gallon (11.3 L) tank of agent was necessary to cover a 6 ft cooking range including a deep fryer. To be effective, the commercially available fire extinguishing agent must be discharged directly onto each of the cooking appliances. 12 different types of nozzle arrangements with different flow rates, different spray patterns and different spray angles were found to be necessary for the different cooking appliances. For example, an upright grill requires 2 nozzles each with a flow rate of 1.9 L/min/nozzle, a wood/charcoal open grill requires a nozzle at a very high flow rate of 5.6 L/min/nozzle to flood the entire grill. Therefore, for a 6 ft cooking range using commercially available fire extinguishing agents, it is necessary to know the arrangement of the cooking appliances for the range, so that a properly designed system with the proper appliance nozzles can be installed. Because of various nozzle arrangements required, the installation of the piping and the nozzles for such a cooking range requires about 12 hours.

Figure 5:
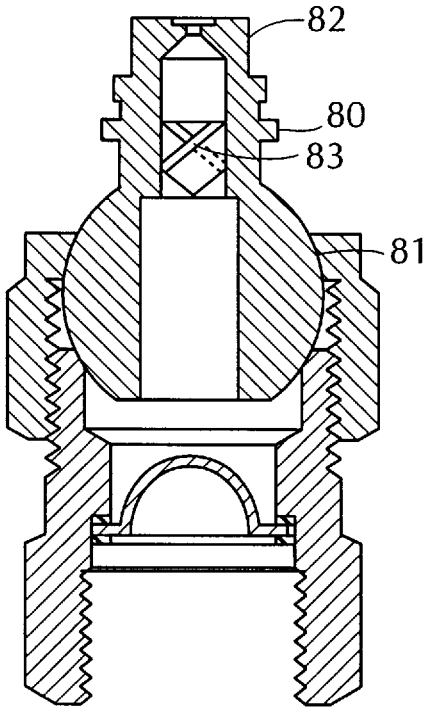
FIG. 5 shows an appliance nozzle useful for the application of the unique fire extinguishing composition of the invention.

With the surprising increase in efficiency of the fire extinguishing composition of the present invention, it has been found that a much simpler fire extinguishing system is needed. 3 gallons (11.3 L) of the fire extinguishing composition dispensed at a flow rate of 4.5 L/min/nozzle is sufficient to cover a 16 ft. cooking range including deep fryers. Only one single nozzle for the various cooking appliances is necessary. The specially designed nozzle 80 having an outlet tip 82 with a swivel joint 81 so that it can be aimed after installation. See FIG. 5. The nozzle tip 82 can rotate up to 30 degrees in any direction from the centerline of the body. The nozzle also includes a vane 83 which twists or spins the fluid being discharged out of the tip to stabilize the existing spray cone. The internal bore of the nozzle tip is machined to a configuration which controls both the critical flow and spray angle of the discharge. In the case of the new appliance nozzle, a nominal flow rate of 1.7 gallons of water per minute (6.4 L/min) at 80 psi nozzle pressure is found to be satisfactory. The spray angle (included angle of the cone of water being discharged) is a nominal 60 degrees. The nozzles are spaced at equal distances of about 70 cm. apart to provide overlapping coverage over the cooking appliances. This system, being much simpler, only requires about 9 hours to install. Therefore, with the fire extinguishing composition of the present invention, not only can the fire be extinguished effectively without the risk of reignition, but better coverage for a much large cooking area with interchangeability of the cooking appliances is attainable. The fire extinguishing system is much easier to design and install. Moreover, because of the need only three different types of nozzles, a plenum nozzle, a duct nozzle and an appliance nozzle, the inventory requirement of nozzles is reduced. The fire, if any occurred, is rapidly extinguished and secured. There is also the increased security of knowing that there is an unlimited supply of available water to provide a much greater margin of safety. Moreover, the chemicals useful in the present invention are non-toxic, easily soluble and can be thus be easily removed by spraying with water and discharged into the sewage system. All of these desirable advantages are gained surprisingly with the fire extinguishing composition of the present invention.

When the fire extinguishing composition comprise sodium or potassium carbonate, special backflow control valve is required to prevent any backflow of the composition into the municipal water supply. Further, the presence of sodium chloride may cause corrosion of the metal parts of the fire extinguishing system or the cooking appliances. For this reason, it is preferable that the composition comprise potassium bicarbonate and sodium/potassium sulfate or tartrate.

The following examples further illustrate the invention.

EXAMPLE 1

Determination of the mole % ratio of a mixture of $KHCO_3$, and $Na_2SO_4$

Varying amounts of sodium sulfate in powder form from 0 mole % to 30 mole % were added to potassium bicarbonate in powder form. Each mixture was mixed thoroughly and a DSC curve obtained using about 10–15 mg. of each mixture. The DSC curve is obtained by using a General V2.2A Dupont 9900 DSC. The temperature is increased at a rate of 10° C./min under $N_2$ purge of 40–60 L/min. At 10–20 mole % of $Na_2SO_4$ added, only one endotherm is observed for the mixture. The endotherms for the softening and melting of each mixture is recorded. The temperature at which the mixture begin to soften was determined at the start of the endotherm by extending the rise in the curve to the baseline. The energy in joules/g absorbed is calculated based on the area under the endotherm. The results are as follows.

TABLE I

| Mole % | | DSC | |
|---|---|---|---|
| $KHCO_3$ | $Na_2SO_4$ | Point | Energy Absorbed |
| 100 | 0 | 189 | 570 |
| 96 | 4 | 204, 225 | 2741 |
| 94 | 6 | 210, 225 | 2560 |
| 90 | 10 | 196 | ND |
| 85 | 15 | 184 | 5066 |
| 75 | 25 | 198 | ND |
| 80 | 20 | 184 | 5066 |
| 0 | 100 | 189 | 794 |

ND — not determined

Although the mixtures containing 15 mole %–20 mole % exhibit the desired characteristics, the mole % ratio of 85:15 of potassium bicarbonate to sodium sulfate is preferred. This is because it provided more potassium bicarbonate for the generation of carbon dioxide.

EXAMPLE 2

Determination of the Mole % ratio of a Mixture of $KHCO_3$ and $K_2C_4H_4O_6$ Following the procedure of Example 1, hydrated potassium tartrate in powder form was added in varying mole % to potassium bicarbonate in powder form. The DSC endotherm were obtained for each mixture. The mole % ratio of potassium bicarbonate to potassium tartrate at which the mixture exhibited a minimum melting temperature of 200° C. was 86:14. The heat absorbed during the process was 4940 joules/g. A small peak observed at about 160° C. is due to the release of the water of hydration from the salts.

EXAMPLE 3

Determination of the Mole % Ratio of a Mixture of $KHCO_3$ and NaCl

Following the procedure of Example 1, mixtures of $KHCO_3$ and NaCl were prepared containing from 1 mole %–30 mole % of NaCl. The DSC endotherms were obtained for each mixture. The mole % ratios of $KHCO_3$:NaCl at which the mixtures exhibited a single melting temperature were about 80:20. Fire testing showed that the mixture was useful at 8–22 wt % conc. with a mole % ratio of 88:12 to 86:14 being preferred.

EXAMPLE 4

Testing of a Combination of a Mixture of $KHCO_3$ and $Na_2SO_4$ and Water

Three aqueous solution, at concentrations of 18 wt %, 20 wt % and 22 wt %, of a mixture of $KHCO_3$ and $Na_2SO_4$ in a mole % ratio of 85:15 was prepared.

Each of the solutions was tested as follows. The solution was placed in a holding tank with a manual release valve mounted thereon. A fire was ignited in a commercial deep fryer and allowed to burn for 2 minutes in accordance with the standard protocol of Underwriters Laboratory, UL 300 Standard for testing of fire suppression systems for restaurant cooking areas. A thermistor probe place in the deep fryer was used to measure the temperature of the oil during the process. The temperature of the oil after burning actively for 2 minutes was about 390.5° C. The release valve was manually actuated and a spray of the solution at a nozzle flow rate of 0.8–0.95 L/min/nozzle was applied through a nozzle mounted 115 cm over the deep fryer until the fire was extinguished. The time taken to accomplish this was noted. A blanket of thick foam on the hot oil was observed. The temperature of the oil was 390° C. After about 5 sec water was discharged through the nozzle onto the deep fryer.

In each case, the blanket of foam continued to form on top of the oil. The time required to extinguish the flames is shown in Table II. A layer of foam was observed to thicken continuously on the surface of the oil as the water was added. After about 2 minutes, the temperature of the oil decreased to below 332° C., the reflash temperature of the oil. No reflash occurred.

TABLE II

| Conc. | Mole % Ratio | Time To Extinguish | Foam Blanket |
|---|---|---|---|
| 20% | 85:15 | 2–7 sec | Yes |
| 18% | 86:14 | 2–7 sec | Yes |
| 22% | 87.5:12.5 | 2–8 sec | Yes |

EXAMPLE 5

Comparative Examples

Commercially available fire extinguishing agents comprised of potassium citrate, potassium acetate or potassium carbonate were tested in accordance with the procedure described by the manufacturers and in accordance with the UL 300 standard protocol.

With these agents, the fire was extinguished in about 3–7 sec, reflash occurred in about 10–15 sec.

We claim:

1. A fire extinguishing composition comprising of an aqueous solution of 15 wt %–30 wt %, a eutectic mixture of Salt I and Salt II, wherein Salt I is selected from the group consisting of carbonate or bicarbonate of sodium or potassium; salt II is selected from the group consisting of a chloride, sulfate, or tartrate of sodium or potassium in a mole % ratio of I to II from about 80:20 to 90:10.

2. A combination of the composition of claim 1 and water.

3. A composition according to claim 1 wherein the mixture is potassium bicarbonate and sodium sulfate in a mole % ratio of 90–85:10–15.

4. A combination of the composition of claim 3 with water.

5. A combination according to claim 2 wherein the concentration of the aqueous solutions is 20 wt % and the mole % ratio of potassium bicarbonate to sodium sulfate is 85:15.

6. A composition according to claim 1 wherein the solution is prepared in situ by passing water through a cartridge containing a mixture of salt I and salt II in the form of a powder.

7. A combination of the composition of claim 6 with further amount of water.

8. A composition according to claim 1 wherein the mixture is potassium bicarbonate and sodium chloride at a moles ratio of 88–86:12–14.

9. A composition according to claim 8 wherein the mole % ratio is 86:14.

10. A combination of the composition of claim 8 or claim 9 with water.

11. A combination according to claim 9 wherein the aqueous solution of the mixture is dissolved in water at a concentration of 15–25 wt %.

12. A composition according to claim 1 wherein the mixture is potassium bicarbonate and potassium tartrate at a mole % ratio of 80–90:20–10.

13. A composition according to claim 12 wherein the mole % ratio is 86:14.

14. A combination of the composition of claims 12 or 13 with water.

15. A combination according to claim 14 wherein the mixture is dissolved in water at a concentration of 15–25 wt %.

16. A method of extinguishing a fire by applying a combination of claims 2, 4, 5, 7, 10, 11, 14 or 15.

17. A method according to claim 16 wherein the aqueous solution of the mixture is applied at a flow rate of 4.5–7.5 L/min for 2–10 sec followed by water at the same flow rate and pressure for at least 120 sec.

18. A method according to claim 17 wherein the aqueous solution of the mixture is applied at a flow rate of 6.5 L/min at 30 psi for 10 sec followed by water at the same flow rate and pressure for at least 120 sec.

19. A method according to claim 16 wherein the combination is applied manually.

20. A method according to claim 16 when the combination is actuated and applied automatically when a fire is detected.

* * * * *